US008151604B2

(12) United States Patent
Thomas et al.

(10) Patent No.: US 8,151,604 B2
(45) Date of Patent: Apr. 10, 2012

(54) LOOP LOCK HAVING OFFSET CYLINDER AXIS

(75) Inventors: Manuel Thomas, Schwelm (DE); Hoi Jarm Ng, Hong Kong (CN); Wai Leung Ng, legal representative, Hong Kong (CN)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 30 days.

(21) Appl. No.: 12/861,897

(22) Filed: Aug. 24, 2010

(65) Prior Publication Data

US 2011/0048082 A1 Mar. 3, 2011

(30) Foreign Application Priority Data

Aug. 27, 2009 (DE) ..... 10 2009 039 156

(51) Int. Cl.
*E05B 73/00* (2006.01)

(52) U.S. Cl. ..... 70/14; 70/49; 70/58; 70/233; 70/386

(58) Field of Classification Search ..... 70/14, 18, 70/30, 49, 58, 233, 386
See application file for complete search history.

(56) References Cited

U.S. PATENT DOCUMENTS

| | | | | |
|---|---|---|---|---|
| 1,692,826 | A * | 11/1928 | Ganz | 70/231 |
| 1,921,434 | A * | 8/1933 | Stone | 70/259 |
| 3,525,242 | A * | 8/1970 | Young | 70/231 |
| 3,535,242 | A | 10/1970 | Hashimoto et al. | |
| 4,347,720 | A | 9/1982 | Kenyon | |
| 4,697,444 | A | 10/1987 | Maffey | |
| 4,850,207 | A | 7/1989 | Ylven | |
| 5,170,650 | A | 12/1992 | Kortenbrede | |
| 5,447,043 | A * | 9/1995 | Hwang | 70/49 |
| 5,664,445 | A * | 9/1997 | Chang | 70/34 |
| 5,752,416 | A * | 5/1998 | Nien | 74/551.8 |
| 5,829,280 | A | 11/1998 | Chen | |

(Continued)

FOREIGN PATENT DOCUMENTS

CN 201110064 Y 9/2008

(Continued)

OTHER PUBLICATIONS

European Search Report dated Dec. 29, 2010. EP No. 10008673.5.

(Continued)

*Primary Examiner* — Lloyd Gall
(74) *Attorney, Agent, or Firm* — Gifford, Krass, Sprinkle, Anderson & Citkowski, P.C.

(57) ABSTRACT

The invention relates to a loop lock, in particular to a chain lock or to a wire cable lock, having a lock body which has a longitudinal axis and which surrounds a cylinder housing of a lock cylinder and having a loop, wherein the first end of the loop is permanently fastened to a fastening point of the cylinder housing and is aligned perpendicular to the longitudinal axis of the lock body, wherein a second end of the loop can be releasably fastened to a longitudinal end of the lock body and is aligned coaxially to the longitudinal axis of the lock body; and wherein a cylinder core of the lock cylinder is rotatably journalled about an axis of rotation in the cylinder housing and is characterized in that the axis of rotation of the cylinder core is offset in parallel with respect to the longitudinal axis of the lock body, namely away from the fastening point for the first end of the loop.

12 Claims, 4 Drawing Sheets

U.S. PATENT DOCUMENTS

| | | | | |
|---|---|---|---|---|
| 6,481,250 | B1 * | 11/2002 | Kuo | 70/49 |
| 6,854,302 | B2 * | 2/2005 | Zapushek et al. | 70/34 |
| 6,923,027 | B1 | 8/2005 | Kuo | |
| 2003/0015007 | A1 | 1/2003 | Zapushek et al. | |
| 2003/0196462 | A1 * | 10/2003 | Chen | 70/49 |
| 2009/0025433 | A1 * | 1/2009 | Evans | 70/49 |

FOREIGN PATENT DOCUMENTS

| | | | |
|---|---|---|---|
| DE | 32 06 709 | A1 | 9/1983 |
| DE | 86 28 436 | U1 | 2/1987 |
| DE | 41 20 814 | C2 | 1/1993 |
| DE | 4434585 | A1 | 4/1996 |
| DE | 195 20 728 | A1 | 12/1996 |
| DE | 202005013831 | U1 | 11/2005 |
| EP | 0 415 355 | A2 | 3/1991 |
| EP | 0 415 355 | B1 | 3/1991 |
| EP | 0520154 | B1 | 12/1992 |
| EP | 0641908 | B1 | 3/1995 |
| EP | 0785328 | A1 | 7/1997 |
| FR | 2710307 | A1 | 3/1995 |
| JP | 2006037431 | A | 2/2006 |

OTHER PUBLICATIONS

Translation of German Search Report dated Aug. 27, 2009. DE 10 2009 039 156.8.

* cited by examiner

LOOP LOCK HAVING OFFSET CYLINDER AXIS

CROSS-REFERENCE TO RELATED APPLICATION

This application claims priority of German Patent Application 10 2009 039 156.8 filed Aug. 27, 2009, which is incorporated herein by reference.

FIELD OF THE INVENTION

The present invention relates to a loop lock, in particular to a chain lock or to a wire cable lock, having a lock body which has a longitudinal axis and which surrounds a cylinder housing of a lock cylinder and having a loop, wherein a first end of the loop is permanently fastened to a fastening point of the cylinder housing and is aligned perpendicular to the longitudinal axis of the lock body, wherein a second end of the loop is releasably fastened to a longitudinal end of the lock body and is aligned coaxially to the longitudinal axis of the lock body, and wherein a cylinder core of the lock cylinder is rotatably journalled about an axis of rotation in the cylinder housing.

BACKGROUND OF THE INVENTION

Such a loop lock is known from DE 44 34 585 A1.

In such a lock, an otherwise cylindrical lock body and/or a cylinder housing are enlarged in the region of the fastening point for the first end of the loop or are provided with moldings to provide a sufficient material volume for a secure fastening of the first end of the loop. However, this results in a relatively bulky design of the lock body.

SUMMARY OF THE PRESENT INVENTION

It is therefore the object of the present invention to provide a lock of the initially named kind which is simple to produce and is compact in construction and in which nevertheless a secure fastening of the first end of the loop can be ensured.

The object is satisfied in that the axis of rotation of the cylinder core is offset in parallel with respect to the longitudinal axis, namely away from the fastening point for the first end of the loop.

In contrast to a purely coaxial arrangement of the cylinder core with respect to the lock body or to the cylinder housing known from the prior art, the cylinder housing thus has a larger thickness in the region of the fastening point which is required for a mechanically stressable fastening of the first end of the loop without, however, the cylinder housing having to be widened outwardly in the region of the fastening point or having to be provided with moldings. A slimmer cylinder housing and a correspondingly small constructional shape of the lock body thus result overall without compromises in the security.

The loop lock in accordance with the invention is also able to be made lighter and less expensively due to the thereby possible cylindrical construction shapes of the lock body or of the cylinder housing, which are easy to manufacture, without additional moldings for the reception of the first end of the loop.

In accordance with a preferred embodiment, an axial prolongation of the cylinder housing serves as a bolt receiver for the second end of the loop, with the axis of the bolt receiver coinciding with the longitudinal axis of the lock body. The axis of rotation of the cylinder core is thus also parallel with respect to the axis of the bolt receiver and is offset away from the fastening point for the first end of the loop.

An inner sleeve which can be actuated by the lock cylinder and which has a plurality of locking element receivers distributed over its periphery is preferably rotatably received in the axial prolongation, in particular at its inner surface.

In accordance with a further advantageous embodiment, the axial prolongation has a plurality of escape openings which are in particular axially introduced and which are associated with the locking element receivers.

In a further preferred embodiment, locking elements are arranged in the locking element receivers which engage into a peripheral groove of a bolt received in the bolt receiver and forming the second end of the loop and which can escape back into the escape openings for a release of the bolt in the release position in dependence on a rotary position of the inner sleeve relative to the axial prolongation in a closed position. A very compact closing mechanism is thereby implemented which nevertheless fixes the bolt in the bolt receiver in the closed position.

The escape openings preferably have inclined cam surfaces in the rotary direction of the inner sleeve with respect to the inner surface of the axial prolongation, said cam surfaces being made to control the locking elements between the closed position and the release position. On a rotary movement into the closed position, the inclined cam surfaces come into contact with the locking elements and, on an increasing rotation of the inner sleeve, likewise move them increasingly radially inwardly so that the locking elements can then finally engage into the peripheral groove of the bolt received in the bolt receiver. On a rotation of the inner sleeve into the release position, the escape openings, which are covered in the closed position, are released so that the locking elements can escape back radially outwardly into the escape openings, whereby the interior of the bolt receiver is released for the removal of the bolt.

The cylinder core preferably has a catch pin at its end face remote from the key receiver, said catch pin being arranged eccentrically to the axis of rotation of the cylinder core and cooperating with a cam gate, in particular with an elongate hole, provided at an end face of the inner sleeve facing the cylinder core for the actuation of the inner sleeve. The combination of catch pin and cam gate implements in a simple manner a transmission of a rotary movement of the cylinder core onto the inner sleeve despite the axial offset of the axes of rotation of the cylinder core and of the inner sleeve.

In accordance with a further preferred embodiment, two steel pins are inserted into the cylinder housing parallel to one another and also parallel to the longitudinal axis of the lock body such that the two steel pins engage tangentially into a ring groove of a connector piece fastened to the first end of the loop. The steel pins are in this respect inserted into that region of the cylinder housing which has an increased thickness body in accordance with the invention due to the eccentric arrangement of the cylinder core in the lock. Instead of a fastening with steel pins, any other desired type of fastening can also be implemented in the region of increased thickness; a fastening would in particular also be possible by means of a circlip, of a U-shaped clamp or of only one pin.

Further preferred embodiments of the invention are set forth in the dependent claims, in the description and in the drawing.

BRIEF DESCRIPTION OF THE DRAWINGS

The invention will be described in the following with reference to an embodiment and to the drawing. There are shown.

DETAILED DESCRIPTION OF THE PREFERRED EMBODIMENTS

Figure 1:
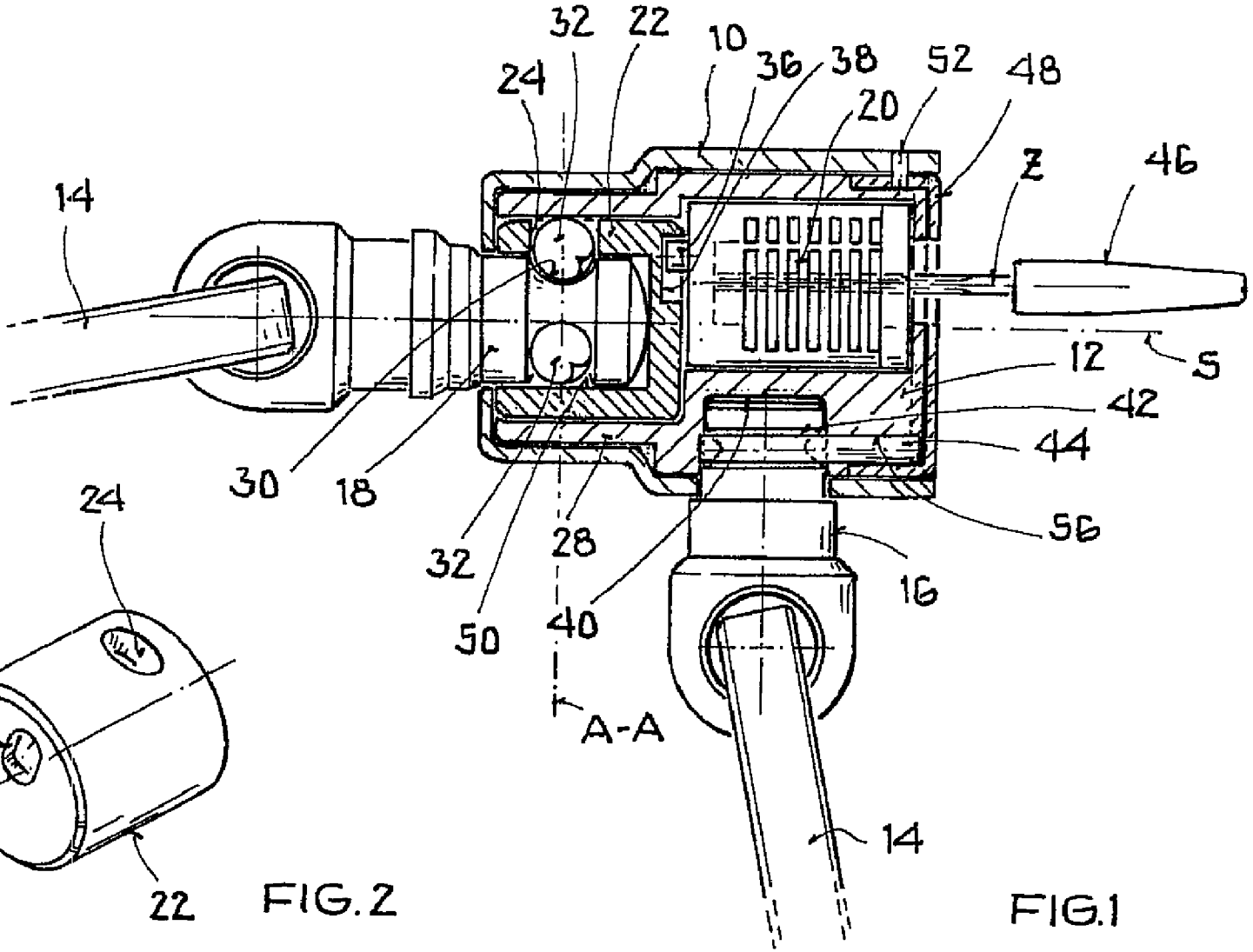
FIG. 1 is a loop lock in accordance with the invention in accordance with an embodiment in a partly sectional view.
Figure 2:
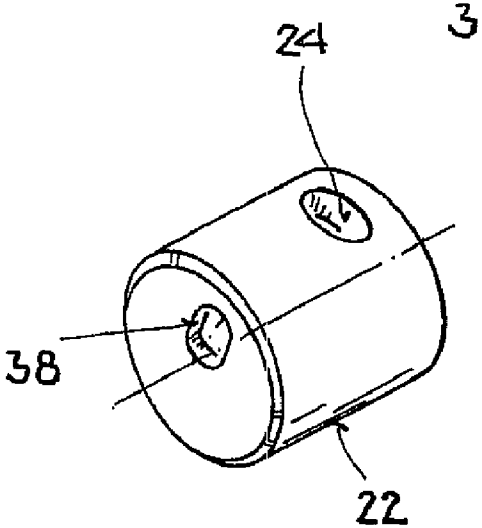
FIG. 2 is a perspective view of an inner sleeve of the loop lock of FIG. 1.

In accordance with FIGS. 1 to 6, a loop lock in accordance with the invention includes a cylindrical body 10 which surrounds a likewise cylindrical cylinder housing 12 of a lock cylinder. A cylinder core 20 is provided in the cylinder housing 12 and has a plurality of blocking members which are known per se and which can be actuated by means of a key 46. In a closed position of the loop lock in accordance with the invention, a rotation of the cylinder lock 20 is not possible when the key 46 has been removed. The axis of rotation Z of the cylinder core 20 is offset in parallel with respect to the longitudinal axis S of the lock body 10.

The cylinder housing 12 has different wall thicknesses in the region of the cylinder core 20 due to this offset. In the peripheral region of the largest wall thickness, a connector piece receiver 40 in the form of a radial bore is provided in which a connector piece 16 of a loop 14 is received. In the present embodiment, the loop 14, only shown schematically, is made as a chain, with a design as a steel cable or in another suitable manner also being possible, however.

The connector piece 16 has at its free end, which is received in the connector piece receiver 40, a ring groove 42 into which two steel pins 44 engage which are spaced apart from one another in parallel, which are aligned parallel to the longitudinal axis S and which are inserted into corresponding axial bores 56 of the cylinder housing 12 and thus connect the connector piece 16 fixedly, but rotatably about its longitudinal axis, to the cylinder housing 12.

A cup-shaped inner sleeve 22 is rotatably received at the inner surface of the axial prolongation 28 and can be actuated by the cylinder core 20. The inner sleeve 22 has three locking element receivers 24 which are distributed over its periphery and in which a respective locking element, here made as a locking ball 32, is movably received in the radial direction. In this respect, the locking element receivers 24, which are preferably made as radial bores, are designed such that the locking balls 32 only extend into the interior of the inner sleeve 22 up to a specific amount and can in particular not fall out of the locking element receivers 24.

The open side of the cup-shaped inner sleeve 22 forms a bolt receiver 50 in which a bolt 18 fastened to the other free end of the loop 14 is received in the closed position of the loop lock. The bolt 18 has a peripheral groove 30 into which the locking balls 32 engage in the closed position shown in FIGS. 1 and 6.

The inner sleeve 22 has an elongate hole at its end face remote from the bolt receiver 50, i.e. at its base, said elongate hole cooperating with a catch pin 36 which is arranged at the end face of the cylinder core 20 remote from a receiver for the key 46 and radially spaced apart from the axis of rotation Z of said cylinder core and engages into the elongate hole 38. A rotary actuation of the cylinder core 20 is converted via the catch pin 36 and the elongate hole 38 into a rotary movement of the inner sleeve 22. A radial relative movement, which occurs on the actuation of the cylinder core 20, between the catch pin 36 and the inner sleeve 22 is compensated by the elongate hole 38.

The axial prolongation 28 has three escape openings 26 which are distributed over its periphery, which are associated with the locking element receivers 24 and which cover them in the release position. The escape openings 26 can be made as radially introduced bores whose diameter is somewhat larger than the diameter of the locking element receivers 24, in particular to compensate production tolerances. The rim of the escape openings 26 can be chamfered to form a cam surface 34 for the locking balls 32, for example by countersinking the bores or by conical bores. Alternatively, the escape openings 26 can also be made as bores which are obliquely aligned with respect to a radial alignment within a normal plane to the longitudinal axis S of the lock body 10 (that is within the sectional plane in accordance with FIGS. 5 and 6), i.e. the respective axis of the escape openings 26 does not intersect the longitudinal axis S. A clamping engagement of the locking balls 32 into the escape openings 26 can hereby be ensured with a particularly simple production. Alternatively to the other embodiment as bores, the escape openings 26 can also be formed as slots axially introduced at the free end of the axial prolongation 28.

The end of the lock body 10 facing the bolt receiver 50 is radially inwardly curved and engages over the cylinder housing 12 including the axial prolongation 28 and the inner sleeve 22. A cover cap 48 is inserted into the other end of the lock body 10, said cover cap being provided with an opening for the key 46 and being unreleasably connected to the lock body 10 by means of securing pins 52 which are received in friction-locking manner in bores in the lock body 10 or the cover cap 48 which are provided along the periphery of the lock body 10 or of the cover cap 48. The cylinder housing 10, the cylinder core 20 and the inner sleeve 22 are fixed in the axial direction by the cover cap 48 connected to the lock body 10.

Figure 3:
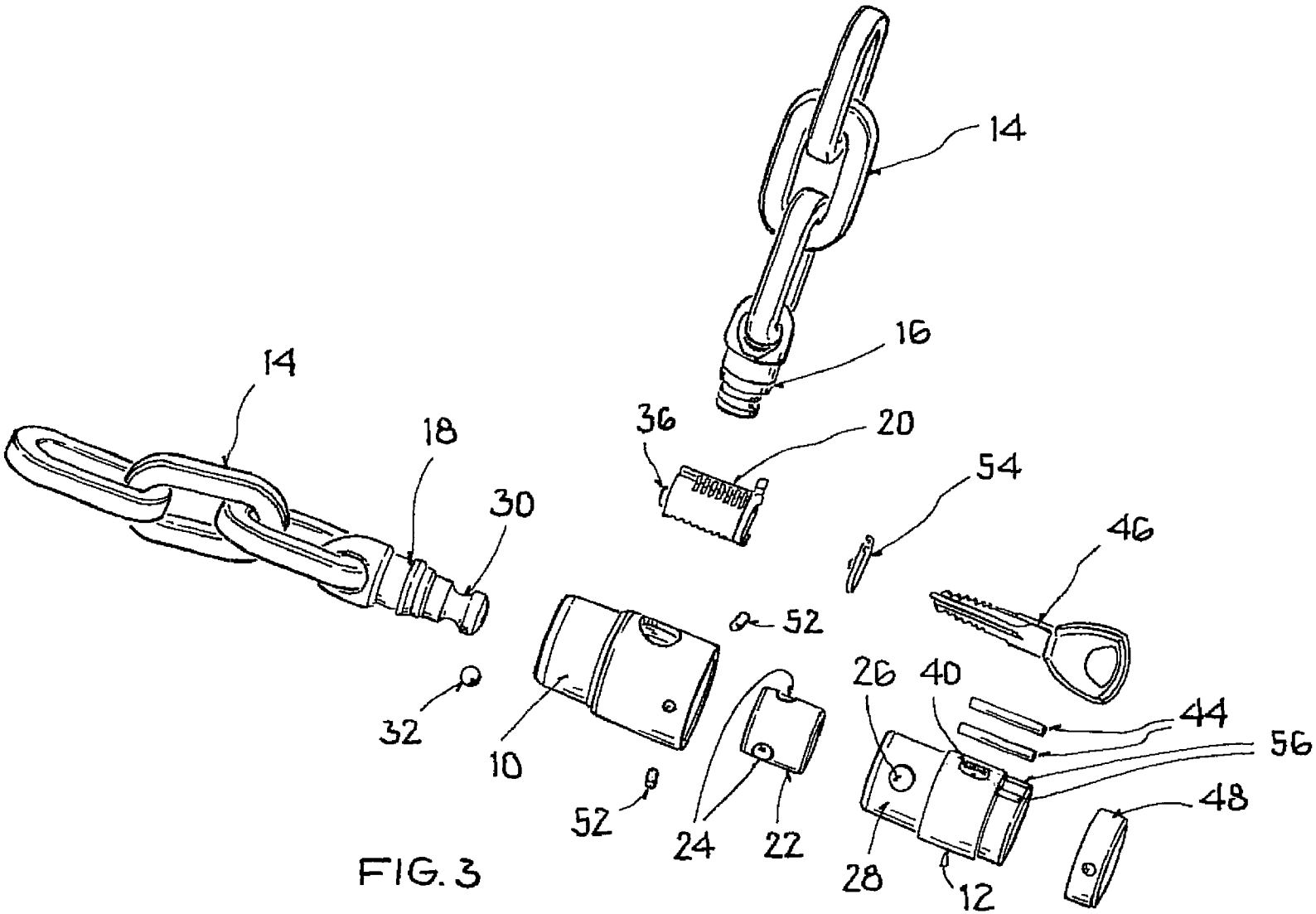
FIG. 3 is an exploded view of the loop lock of FIG. 1.

A drilling protection plate 54 which is shown in FIG. 3 can additionally be arranged between the cylinder core 20 and the cover cap 48.

Figure 4:
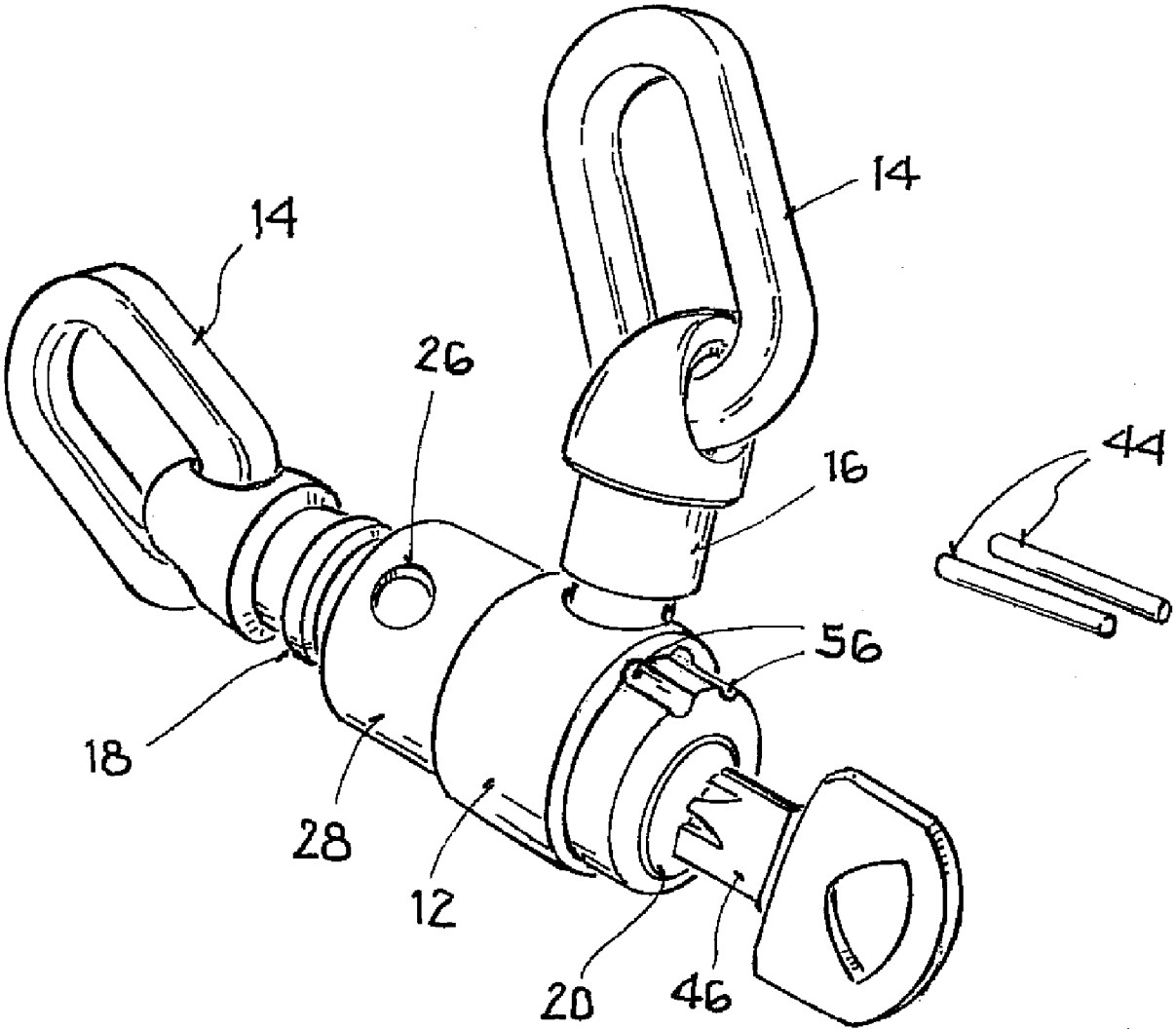
FIG. 4 is a perspective view of the loop lock in accordance with FIG. 1 while omitting the lock body.

The loop lock in accordance with the invention is shown without the lock body 10 in FIG. 4. In this respect, the two axial bores 56 can be recognized into which the steel pins 44 are pressed for the fastening of the connector piece 16 in the connector piece receiver 40.

Figure 6:
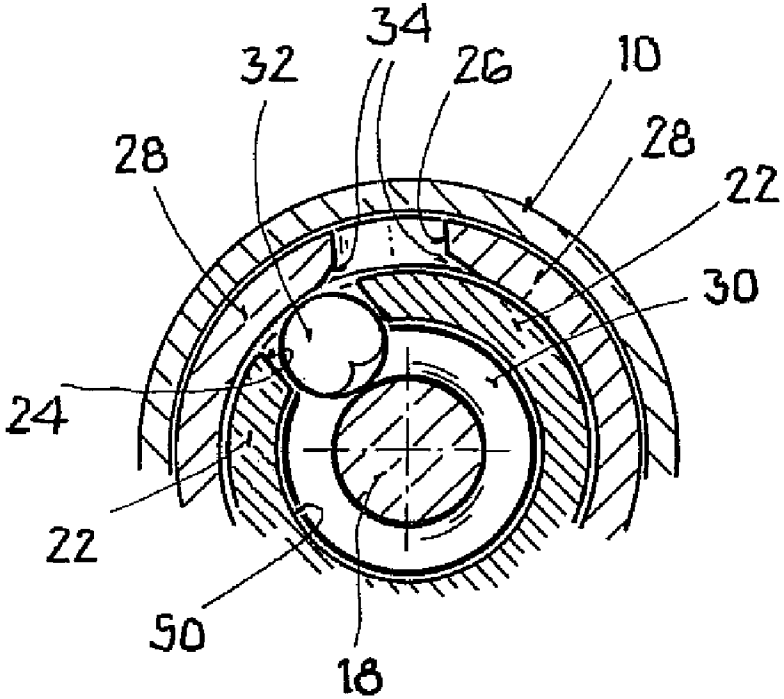
FIGS. 5 and 6 are a sectional view of details through the loop lock in accordance with FIG. 1 in a release position and in a closed position.

The latching mechanism for the bolt 18 will now be explained with reference to FIGS. 5 and 6 which show a part of a cross-section extending along a plane A-A (FIG. 1). In the release position shown in FIG. 5, the locking element receiver 24 coincides with the escape opening 26. If now the inner sleeve 22 is rotated counter-clockwise with respect to the axial prolongation 28, the locking ball 32 held in the locking element receiver 24 is urged in the course of the rotary movement toward the cam surface 34 which is provided at the rim of the escape opening 26 and which is inclined with respect to the inner surface of the axial prolongation 28 in the direction of rotation of the inner sleeve 22. The locking ball 32 is thereby displaced radially inwardly and moves, as shown in FIG. 6, into the peripheral groove 30 of the bolt 18 pushed into the bolt receiver 50. In this closed position, the peripheral groove 30 engages behind the locking ball 32 so that the bolt 18 is secured rotatably about its longitudinal axis in the bolt receiver 50.

Figure 5:
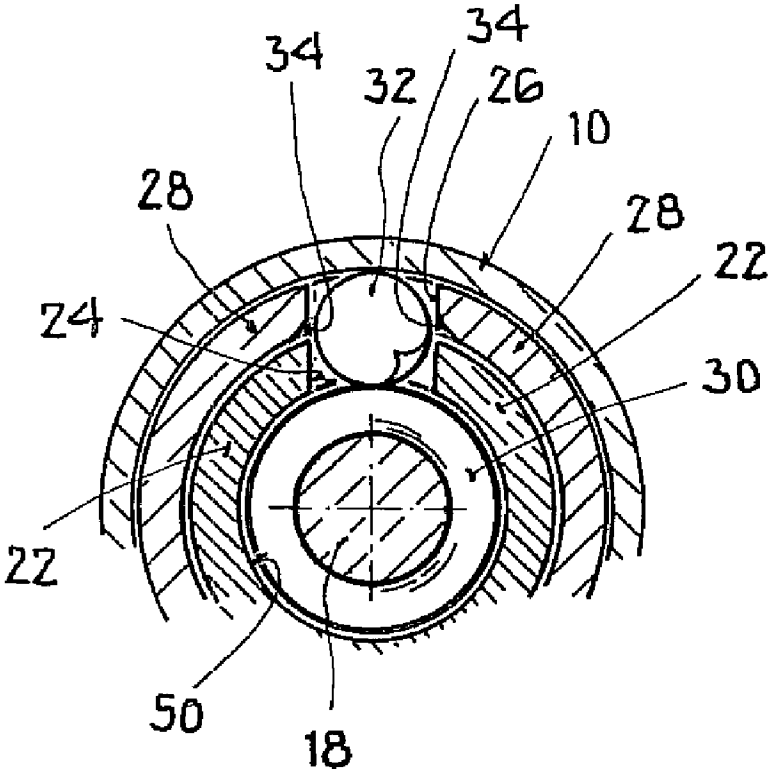

If now the inner sleeve 22 is rotated clockwise, it returns into the position in accordance with FIG. 5 so that now the locking element receiver 24 again coincides with the escape opening 26. On the pulling out of the bolt 18, the locking ball 32 can escape back into the escape opening 26 and thus again releases the bolt 18.

It has been found that the escape openings 26 do not necessarily have to be provided with chamfered cam surfaces 34 since a clamping-free control is also ensured with cylindrical escape openings due to the ball shape of the locking balls 32.

As can easily be recognized in FIGS. 1, 3 and 4, the lock body 10 or the cylinder housing 12 can be made with a substantially cylindrical contour without disturbing necks or thickened portions. Due to the arrangement of the cylinder core 20 offset out of center, a sufficient material thickness is nevertheless available in a peripheral region of the cylinder housing 12, which corresponds to the fastening point for the loop 14, to be able to fasten the connector piece 16 reliably in the connector receiver 40.

The invention claimed is:

1. A loop lock having a lock body (10) which has a longitudinal axis (S) and which surrounds a cylinder housing (12) of a lock cylinder, and having a loop (14), wherein a first end (16) of the loop (14) is permanently fastened to a fastening point of the cylinder housing (12) and is aligned perpendicular to the longitudinal axis (S) of the lock body (10);

wherein a second end (18) of the loop (14) can be releasably fastened to a longitudinal end (28) of the lock body (10) and is aligned coaxially to the longitudinal axis (S) of the lock body (10); and wherein a cylinder core (20) of the lock cylinder is rotatably journalled about an axis of rotation (Z) in the cylinder housing (12), characterized in that the axis of rotation (Z) of the cylinder core (12) is offset in parallel with respect to the longitudinal axis (S) of the lock body (10), namely away from the fastening point for the first end (16) of the loop (14).

2. A loop lock in accordance with claim 1, characterized in that an axial prolongation (28) of the cylinder housing (12) serves as a bolt receiver (50) for the second end (18) of the loop (14), with the axis of the bolt receiver (50) coinciding with the longitudinal axis (S) of the lock body (10).

3. A loop lock in accordance with claim 2, characterized in that an inner sleeve (22), which can be actuated by the cylinder core (20) and which has a plurality of locking element receivers (24) distributed over its periphery, is rotatably received in the axial prolongation (28).

4. A loop lock in accordance with claim 3, characterized in that the axial prolongation (28) has a plurality of escape openings (26) associated with the locking element receivers (24).

5. A loop lock in accordance with claim 4, characterized in that locking elements (32) are arranged in the locking element receivers (24), said locking elements engaging into a peripheral groove (30) of a bolt (18) received in the bolt receiver (50) in dependence on a rotary position of the inner sleeve (22) relative to the axial prolongation (28) in a closed position and engaging into the escape openings (26) for a release of the bolt (18) in the release position.

6. A loop lock in accordance with claim 5, characterized in that the escape openings (26) have cam surfaces (34) which extend obliquely to the inner surface of the axial prolongation (28), which have cam surfaces (34) inclined in the direction of rotation of the inner sleeve (22) and which are made to control the locking elements (32) between the closed position and the release position.

7. A loop lock in accordance with claim 4, characterized in that the escape openings (26) are axially introduced in the axial prolongation (28).

8. A loop lock in accordance with claim 4, characterized in that the escape openings (26) are obliquely aligned.

9. A loop lock in accordance with claim 4, characterized in that the cylinder core (20) has a catch pin (36) which cooperates with a cam gate provided at the inner sleeve (22) for the actuation of the inner sleeve (22).

10. A loop lock in accordance with claim 4, characterized in that the lock body (10) peripherally covers the escape openings (26).

11. A loop lock in accordance with claim 1, characterized in that at least one fastening element (44) is provided in the cylinder housing (12) and engages tangentially into a ring groove (42) of a connector piece (16) fastened to the first end (16) of the loop (14).

12. A loop lock in accordance with claim 11, characterized in that the at least one fastening element includes two steel pins (44) inserted into the cylinder housing (12) in parallel to one another as well as parallel to the longitudinal axis (S) of the lock body (10).

* * * * *